US009907717B2

(12) United States Patent
Dennis

(10) Patent No.: US 9,907,717 B2
(45) **Date of Patent: *Mar. 6, 2018**

(54) MATTRESS OVERLAY SYSTEM WITH POSITIONALLY ADJUSTABLE, LATERAL RAMP-WEDGE BOLSTER STRUCTURE

(71) Applicant: Michael Dennis, Scappoose, OR (US)

(72) Inventor: Michael Dennis, Scappoose, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/495,596

(22) Filed: Apr. 24, 2017

(65) Prior Publication Data

US 2017/0224563 A1 Aug. 10, 2017

Related U.S. Application Data

(63) Continuation of application No. 15/232,615, filed on Aug. 9, 2016, now Pat. No. 9,757,296, which is a continuation of application No. 14/808,129, filed on Jul. 24, 2015, now Pat. No. 9,439,821, which is a continuation of application No. 13/647,323, filed on Oct. 8, 2012, now Pat. No. 9,119,754.

(60) Provisional application No. 61/545,136, filed on Oct. 8, 2011.

(51) Int. Cl.
*A61G 7/05* (2006.01)
*A61G 7/057* (2006.01)

(52) U.S. Cl.
CPC ..... *A61G 7/0525* (2013.01); *A61G 7/05715* (2013.01); *A61G 7/05784* (2016.11)

(58) Field of Classification Search
CPC ..... A61G 7/05715; A61G 7/0525; A61G 2007/05784
See application file for complete search history.

(56) References Cited

U.S. PATENT DOCUMENTS 5,359,739 A * 11/1994 Rains ..... A47C 21/08 5/424
6,256,822 B1 * 7/2001 Weston ..... A47C 21/08 5/731
6,848,130 B1 * 2/2005 Wilson ..... A47C 21/08 5/425

(Continued)

FOREIGN PATENT DOCUMENTS

JP 2003325591 A * 11/2003
JP 2003339788 A * 12/2003

*Primary Examiner* — Eric J Kurilla
(74) *Attorney, Agent, or Firm* — Mohr Intellectual Property Law Solutions PC

(57) ABSTRACT

A bolster structure system possesses anti-decubitus ulcer characteristics, and may cooperate with a mattress overlay also having anti-decubitus ulcer capabilities as part of a mattress overlay system, in which multiple elongate, positionally adjustable, relatively moveable bolsters are configured for selective placement in conditions of lateral under-engagement with the sides of an overlay to create inclined, lateral side elevations of these sides at locations along the length of the overlay. The bolster structure and overlay may each include a dynamic-response core expanse formed of an open-cell, compressible viscoelastic foam coated with an elastomeric, moisture- and gas-flow-managing, differential-thickness coating structure load-transmissively bonded to the entirety of the outside of said core expanse to function as a dynamically-responsive unit therewith.

16 Claims, 2 Drawing Sheets

(56) References Cited

U.S. PATENT DOCUMENTS

| | | | | |
|---|---|---|---|---|
| 2002/0148047 | A1* | 10/2002 | Corzani | A47C 27/006 5/738 |
| 2002/0170117 | A1* | 11/2002 | Flick | A61G 7/001 5/715 |
| 2010/0154127 | A1* | 6/2010 | Walter | A47G 9/0246 5/732 |
| 2010/0186172 | A1* | 7/2010 | Dennis | A47C 27/14 5/740 |
| 2010/0192306 | A1* | 8/2010 | Dennis | A47C 27/14 5/699 |
| 2011/0072589 | A1* | 3/2011 | Dennis | A47C 27/14 5/691 |

* cited by examiner

MATTRESS OVERLAY SYSTEM WITH POSITIONALLY ADJUSTABLE, LATERAL RAMP-WEDGE BOLSTER STRUCTURE

RELATED APPLICATION

This application is a continuation of co-pending U.S. patent application Ser. No. 14/808,129, filed on Jul. 24, 2015. U.S. patent application Ser. No. 14/808,129 is an application claiming the benefit of U.S. Pat. No. 9,119,754, filed on Oct. 8, 2012. U.S. Pat. No. 9,119,754 is an application claiming the benefit of U.S. Provisional Application, Ser. No. 61/545,136, Filed on Oct. 8, 2011. The entire disclosures of all of the above referenced patent application are hereby incorporated by reference for all purposes.

TECHNICAL FIELD

This disclosure relates to an anti-decubitus ulcer mattress overlay system featuring an anatomical, pressure-evenizing mattress overlay having anti-decubitus ulcer characteristics, and a ramp-wedge bolster structure configured to be selectively placeable in conditions of lateral under-engagement with the sides of such an overlay to create inclined, lateral-side elevations of these sides at locations along the length of the overlay, with the bolster structure also having anti-decubitus ulcer characteristics.

BACKGROUND

It has been recognized for some time that the medical issue involving the development of decubitus ulcers in bed-ridden patients, often those who are still in the environment of a hospital recovering from some medical event or condition, is a serious problem. Although there have been many approaches to solving this problem, many have shortcomings because they fail to grasp a full understanding of the key body-support and contact conditions that should exist decubitus ulcer onset is to be reduced. In other words, prior art solutions are largely ineffective because they do not properly recognize, and address, the conditions under which decubitus ulcers develop.

Example embodiments of an effective anti-decubitus ulcer mattress overlay configured to function principally on the surface of a yieldable, underlying support structure, such as that furnished by a conventional hospital bed mattress, are provided in U.S. patent application Ser. No. 12/960,493, the entire disclosure of which is incorporated herein by reference for all purposes. The example mattress overlays disclosed therein possess various characteristics effective in reducing the possibility of decubitus ulcer onset (these characteristics are also referred to herein as "anti-decubitus ulcer characteristics"), such as (1) avoiding high, applied anatomical pressure, and/or pressure-evenizing contact-loading characteristics defining how the anatomy of a bed-ridden patient is supported, (2) reducing friction and shear engagement between the overlay structure and a supported patient, providing effective, ventilating, heat-removing, perspiration-managing, cooling airflow in the volumetric region disposed beneath supported anatomy, such as to avoid overheating, and so forth.

There are circumstances, for example with regard to a bed-ridden patient, where it is important that some form of a protecting guard structure be provided, such as in order to restrict a patient's movement—for example, a lateral guard structure to prevent a patient from inadvertently and accidentally rolling off the under-anatomy structure and falling.

While there are many approaches to accomplishing such a guarding function, such as, for example, the installation of a rail system in the case of a hospital bed structure, or the installation of relatively firm (i.e. non-yieldable) and rigid lateral riser structure, these measures may not be suitable for the handling of a patient here, as is now usually always the case, there is a concern that overpressure on the resting anatomy, even for relatively short periods of time, if sustained, may cause the onset of a decubitus ulcer.

SUMMARY

The present disclosure addresses the issues above by offering various embodiments of a mattress overlay system featuring a mattress overlay having anti-decubitus ulcer characteristics and a bolster structure, which also possesses anti-decubitus ulcer characteristics, that is configured to be selectively placeable in conditions of lateral under-engagement with the sides of the overlay to create inclined, lateral-side elevations of these sides at locations along the length of the overlay. In some embodiments, the anti-decubitus characteristics are achieved by both the overlay and the bolster structure having a similar core composition provided with a similar coating.

In some embodiments, the coating (of both the overlay and the bolster structure) in certain locations offers relatively free gas-breathability, and in other locations provides an impervious barrier to both gas and moisture.

In some embodiments, the core (of both the overlay and the bolster structure) includes a dynamic-response core expanse formed of an open-cell, compressible viscoelastic foam having a pre-stressed, partially compressed, relaxed-state volume to create a pre-compression condition, and an elastomeric, moisture- and gas-flow-managing, differential-thickness coating structure load-transmissively bonded to the entirety of the outside of the core expanse to function as a dynamically-responsive unit therewith, and possessing a relaxed-state, internal, pre-stressed tension condition, with the coating structure in some, respiration-window regions being formed to be moisture-pervious and gas-permeable, and in other, non-respiration regions, being formed to be substantially moisture-impervious and gas-impermeable.

In some embodiments, portions of the coating structure of the system have an outer surface adapted to provide an interfacial section grip with other similarly-coated portions of the coating structure of the system, such as between the bolster structure and the sides of the overlay when engaged.

In some embodiments, the bolster structure includes multiple elongate bolsters each having a length approximately one-third of that of the overlay and a triangular cross-section along the length thereof. In some of such embodiments, the triangular cross-section specifically defines a right triangle, the sides of which have a relative dimensional ratio of 3:4:5. In some of such embodiments, the coating structure of each bolster defines moisture-pervious, moisture-resistant, and gas-permeable sublayers enclosing the entirety of the outside of its core expanse, and a moisture-impervious and gas-impermeable outer layer interfacially bonded to the outermost sublayer enclosing only (and thereby defining) non-respiration regions. In some of such embodiments, the respiration regions are disposed on, and extend over the entirety of, the opposed end surfaces of each bolster.

Various embodiments of a bolster structure system configured for use with an elongate anti-decubitus ulcer mattress overlay include elongate, positionally adjustable, relatively moveable, lateral-ramp, under-overlay bolster structure, such as multiple bolsters as briefly described herein.

The systems, concepts, components, features, and configurations briefly described above are clarified with reference to the accompanying drawings and detailed description below.

DETAILED DESCRIPTION

Figure 1:
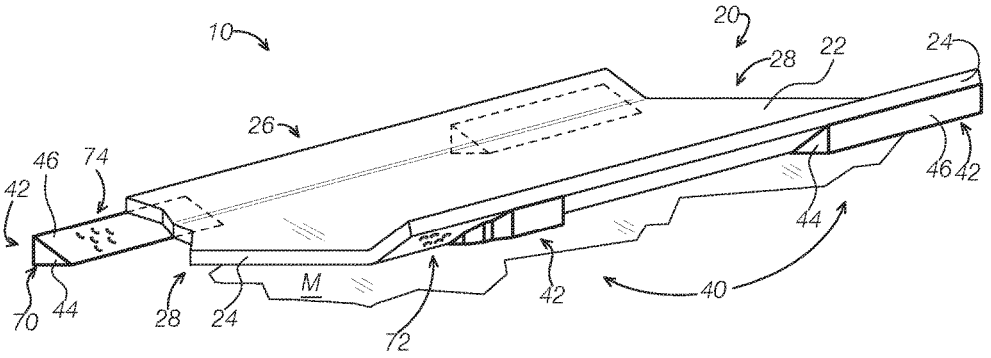
FIG. 1 is a simplified, isometric view of a mattress overlay system constructed in accordance with the present disclosure and including an anatomical, pressure-evenizing mattress overlay and elongate, positionally adjustable, relatively moveable, lateral ramp, under-overlay bolster structure in the form of four wedge-ramp bolsters arranged in symmetrically opposed pairs arranged in a longitudinally-spaced, two-per-lateral-underside of the overlay configuration, with the system shown resting upon a fragmentarily shown hospital bed mattress, with a portion of one corner of the overlay broken away to illustrate details of a surface of one of the bolsters, and also with a portion of another one of the bolsters broken away to illustrate details of a surface of the underside of the overlay.
Figure 2:
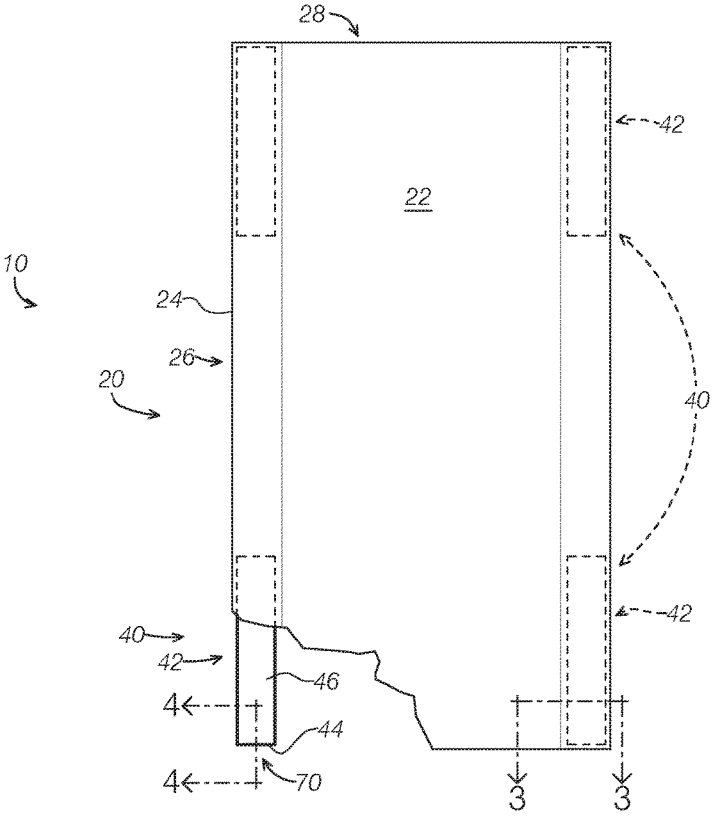
FIG. 2 is a top view in partial cutaway of the system of FIG. 2, providing one example scale of relative dimensions of the bolsters compared to that of the overlay.
Figure 3:
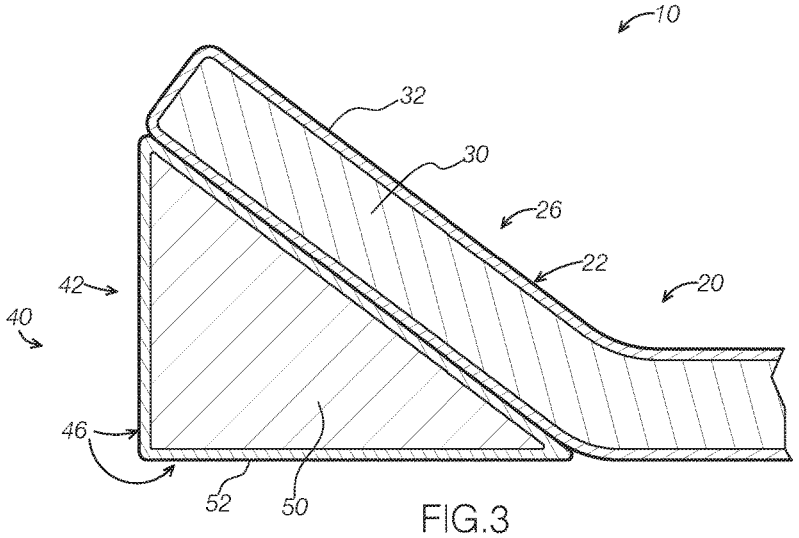
FIG. 3 is a fragmentary cross-sectional view taken generally along the line 3-3 of FIG. 2, showing example internal structural configuration of a bolster and a portion of the overlay.

Referring to the drawings, a non-exclusive, example embodiment of an anti-decubitus ulcer mattress overlay system constructed and configured in accordance with the present disclosure is indicated generally at 10 shown FIGS. 1-3, and is shown to include an elongate mattress overlay 20 and an elongate bolster structure 40, collectively and relatively positioned in the illustrated configuration on the surface of a hospital bed mattress of conventional construction shown generally, and fragmentarily, at M.

The components of the system 10 are not necessarily shown to proper proportion in the drawings, and the artisan will recognize that the dimensions of the overlay and/or the bolster structure may be modified to be suitable for a particular application, such as other environments involving convalescing patients (and that such modifications do not depart from the scope of the disclosure).

That being said, overlay 20 in the illustrated embodiment has a constant, overall thickness of approximately 1 inch, a lateral width of about 36 inches, a length of about 75 inches, and thus approximates a rectangular cuboid in overall shape—as such, mattress overlay 20 defines upper and lower faces 22 spaced by a continuous perimetral edge 24, providing the overlay with sides 26 and ends 28. Further bolster structure 40 in the illustrated embodiment is shown in the form of multiple elongate bolsters 42 particularly, two pairs of symmetrically opposed bolsters 42 each of which approximate the form of a right triangular prism having a length of about 24 inches, a height of about 3 inches, and a width of about 4 inches. More particularly, the three sides of the right-triangular cross-section of each bolster 42 in the illustrated embodiment have a relative dimensional ratio of 3:4:5.

As such, each bolster may be described as having two ends (or end faces, or end surfaces) 44 that are spaced by three sides 46—which may further/alternatively be thought of, for the sake of convenience, as including a base surface, a side surface, and an inclined surface (which, due to being placeable with any one of the sides 46 face-down against a support surface, are not individually numbered in the drawings). Due to the aforementioned 3:4:5 ratio, the inclined surface, as shown, forms an angle of approximately 37 degrees with the base surface and with the surface of the mattress M, on which the base surface is shown to rest.

It is due to the angle of this wedge-like bolster volume—or, in a broader sense, it is due to this variable-thickness bolster structure feature that in the illustrated embodiment is presented as a constant, linear angle of a wedge-like bolster volume—that the bolster structure 40 may be employed in cooperation with overlay 20 to create an inclined, lateral anti-roll-off ramp at different particular locations relative to the overlay. For example, as shown in FIGS. 1 and 2, bolsters 42 of bolster structure 30 are shown to be deployed in a longitudinally-spaced, two-per-lateral-underside of the overlay configuration, creating two pairs of opposed, under-supported, inwardly-inclined overlay regions, at the head and foot of the overlay, so to speak. These under-supported overlay regions are longitudinally separated by an opposed pair of non-bolster-supported inclined overlay regions, which correspond to the unoccupied spaces between the bolsters 42 on each lateral underside, of the overlay.

Different positional configurations of bolsters 42 relative to the overlay from those as shown may be selectively deployed to create different patterns and/or different regions of overlay inclination, bolster-supported and/or non-bolster-supported, as suitable to the nature of the patient's need or application at hand. For example, two or more bolsters may be placed end-to-end, or spaced more closely than as shown along one lateral side and the other, in a completely and/or partly covered (or, put another way, subposed) relationship with the overlay, and so forth; moreover, one or more bolsters 42 may be placed with a different one of its three sides face-down, such as to provide corresponding regions of comparatively greater or lesser degrees of inclination, and/or surface area, etc.

In product development and testing, it was found that bolsters in a size range having a length less that of the overlay, a width of no more than one-third of that of the overlay, and a variable thickness ranging from less than that of the overlay to about 4-6 times the thickness, were suitable for an extremely wide range of applications, and that the specific dimensions of the illustrated embodiment of the bolster structure 40 satisfies the purposes described herein in many if not all situations in which a guarding function is needed.

However, different dimensions than as shown and discussed, bolster structure geometries (e.g., triangular or otherwise providing a variable thickness across at least a portion of the width of the bolster structure, such as that described by one or more flat or curved inclined surfaces relative to a base surface), as well as a greater or lesser number of individual bolsters, bolsters with constant or non-constant cross-sections through their length, and so forth, may optionally be used to achieve a similar purpose. Such variations are considered to be well within the scone of this disclosure.

Whatever the actual configuration, the inclined geometry of the bolster structure provides the aforementioned guarding function, such as to restrict the range of motion of a bed-ridden patient, for example to prevent the patient from moving off of the anti-decubitus ulcer overlay or even from inadvertently rolling off the underlying mattress.

However, it is important for the bolster structure to itself possess anti-decubitus ulcer characteristics similar to those provided by the overlay, for several reasons. For example, as explained below, some embodiments of the bolster structure are provided with a coating structure that provides an interfacial stiction grip, such as to prevent the bolster structure from migrating relative to the overlay from the position in which it is deployed; even so, inadvertent movement of the bolster structure, or even a deployed con figuration a which the bolster structure is not completely subposed relative to the overlay, may expose a surface of the bolster structure that a supported patient may contact. As noted above, contact, and especially prolonged contact, with a support surface creates a risk of decubitus ulcer onset.

In another example, the above-cited U.S. patent application Ser. No. 12/960,493 explains that it is important, in order for the mattress overlay to perform correctly—or in other word to properly provide its anti-decubitus ulcer capabilities—that it be placed upon a yieldable surface (such as a hospital bed mattress); it is analogously important for the inclined regions of the overlay to be similarly, yieldably supported. In the case of non-bolster-supported inclined regions, such as those indicated in FIGS. 1 and 2, and which are located longitudinally between two spaced bolsters, the "yieldable support" is in the form of the tension inherent in the composition of the non-undersupported, suspended region(s) of the overlay itself, but in the bolster-supported inclined regions, the support is, of course, in the form of bolsters 42. As such, it is important that the bolsters provide this support yieldably, in a manner that that assists, or at least does not interfere with, the overlay in providing anti-decubitus ulcer characteristics. In other words, overfirmness or rigidity in the ramp-creating understructure will tend to defeat the anti-decubitus ulcer capabilities of a supported overlay.

To provide anti-decubitus ulcer characteristics that are similar to those of the overlay, embodiments of the systems disclosed herein include components (i.e., overlay and bolster structure) having similar, and in some cases identical, compositions.

In a general sense, and as is shown, for example, in FIG. 3, both the overlay 20 and the bolster structure 40 (in the form of bolster 42) are formed, basically, from two different components, or portions, including a single-piece, dynamic response core expanse, or core, and a differential-thickness coating, or coating structure. The core expanse of overlay 20 is indicated generally at 30, and the core expanse of bolster structure 40 is indicated generally at 50; the coating structure of the components are indicated generally at 32 and 52, respectively. The terms "core expanse" and "coating structure" (and alternative terms) are used herein, interchangeably in the singular and plural, to indicate that the feature or characteristic being discussed is common to both the overlay and the bolster structure; however, when discussing a characteristic or feature that may differ as between the overlay and bolster structure, the relevant term in the singular case, accompanied by a single reference number, is used.

That being said, the core expanse generally consists of an open-cell, compressible viscoelastic foam material, or materials, selected to have an internal structural character whereby, under changing compression-pressure conditions, it exhibits a compressive-deflection vs. compression-force (or load) curve that includes an extremely linear region over which a relatively wide change in compressive deflection is corresponds to an anatomically insignificant change in compression pressure, a feature that assists in providing evenized support pressure applied statically and dynamically to the underside of a supported anatomy. Example materials exhibiting such internal structure, and thus suitable for selection to form core expanse 30 of overlay 20, are disclosed in U.S. patent application Ser. No. 12/960,493. Example materials suitable for selection to form core expanse 50 of bolster structure 40 include product "B2670," available from IR Specialty Foam, LLC, of Fife, Wash. In some embodiments, the material(s) chosen for the core expanse of both components may have the same composition.

Whatever the material(s), the core expanse, within the structure of the overlay 20 and the bolster structure 40, is in a pre-stressed compressed condition, with a relaxed-state (that is, having no weight resting upon it) compression internally of approximately 8-10% in the embodiments discussed herein, brought about virtue of the presence of allover coating provided by the coating structure, which in the illustrated embodiment is a multi-sublayered, sprayed-on, elastomeric vinyl coating prepared with a differential thickness—specifically, the coating structure is provided in two ranges of thickness, one in which the coating structure is moisture-pervious (but moisture-resistant) and gas-permeable, and one in which the coating structure is moisture-impervious and gas-impermeable. A vinyl material, such as that available as "Miraculon PDF-830" from PlastiDip International in Blaine, Minn., may be used to provide the coating structure, and when applied in a particular manner exhibits a controlled shrinkage responsible for placing the core expanse into nominal overall compression, and the coating structure into a nominal prestressed, tensed condition.

Figure 4:
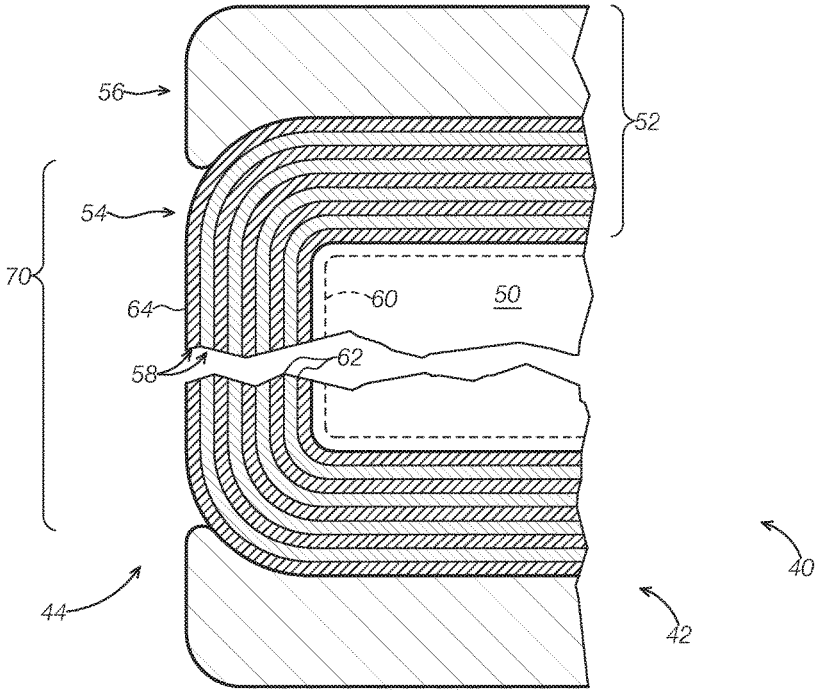
FIG. 4 is a larger-scale, fragmentary cross-sectional view takes generally along the line 4-4 of FIG. 2, illustrating one example configuration of the coating structure at, and proximate to, an end of one of the bolsters.

One example method of applying such a material to create a coating structure for an overlay, such as overlay 20, is described in U.S. patent application Ser. No. 12/960,493, and is suitable for coating both the overlay 20 acid the bolster structure 40 of the present disclosure. As such, the full details of the method will not be repeated herein, but can be summarized with reference to FIG. 4, which fragmentarily and in cross-section shows an end 44, and the region proximate thereto, of a bolster 42.

Coating structure 52 is shown to include two more or less continuous (in terms of coverage of the core expanse) regions designates as an inner region 54 and an outer region 56, with inner region 54 further consisting of a plurality of sublayers 58. Outer region 56 consists of a single layer, and thus is also referred to herein as an "outer layer." Inner region 54 is load-transmissively (mechanically) bonded to core expanse 50, and outer region 56, when/where applied, is load-transmissively bonded to inner region 54.

Briefly, inner region 54 is formed by applying a sequence of individual sublayers 58 to core expanse 50, the first of which is a "primer" sublayer 60 (shown in dashed lines), which penetrates into the outer portion of the core expanse, and several thin, subsequently-applied "basic" sublayers 58, each joined to the next-adjacent sublayer through an initially-wet, interfacial surface of joinder, indicated at 62. The illustrated embodiment features about 10 sublayers each having a thickness of approximately 0.001 inch, and the resulting region 54 exhibits, by virtue of the material, method of application, and sublayer dimensions, moisture-resistant but moisture-pervious and gas-permeable characteristics.

Outer layer 56, as noted above, consists of single layer of material applied to the outermost of the sublayers 58, indicated at 64, at a thickness selected to provide, on its own and/or in combination with underlying region 54, substantial moisture-imperviousness and gas-impermeability. In the illustrated embodiment—that is, employing the aforementioned vinyl material and applying it in the manner more thoroughly described in the aforementioned U.S. patent application Ser. No. 12/960,493—this thickness is approximately 0.01 inch, which is about equal to the combined thickness of the sublayers 58 of inner region 54.

As such, the selective application of outerlayer 56 to outer sublayer 64 during manufacture allows the creation of respiration-window regions (or respiration windows), to provide free breathability to—that is, air- and fluid-flow into and out of—the core expanse of the bolster in a controlled fashion, in terms of the arrangement of one or more respiration windows throughout the entirety of an otherwise fluid-tight coating structure.

Although different arrangements of respiration windows are possible and within the scope of this disclosure, the bolster structure 40 of the illustrated embodiment is provided with respiration windows, generally indicated at 70, located at either end 44 of each bolster 42. Moreover, the respiration windows 70 are disposed one-per-end, and are each coextensive with the area defining the corresponding bolster end 44. In other words, the entirety of the outer surface of the core expanse 30 of each bolster 42 is enclosed with inner region 54 of coating structure 52, but only the sides 42 are additionally covered with outer layer or region 56, so that the outer layer essentially defines both the respiration windows (or, respiration window regions, or respiration regions), and the non-respiration regions.

With the brief summary of the method of application of the coating structure given above in mind, selective application of the outer layer 56 in a desired configuration may be achieved in any of a variety of manners, such as masking the areas or portions of the outermost sublayer 64 that are intended to become the respiration window(s) prior to applying the outer layer 56.

The disposition of the respiration windows 70 at the ends 44 of the bolsters 42 is, at least in part, related to the function/placement of the various exterior surfaces of the bolsters when in use. When deployed, one of the three side surfaces typically contacts the underlying support structure (e.g., mattress M), and another contacts the underside of the overlay and these two side surfaces thereby may be considered to be "obstructed" by the surface wits which the side surfaces are in contact. To allow a user freedom to deploy the bolster in a different configuration, e.g., with different sides contacting the mattress and the overlay, the respiration windows 70 are placed on the ends 44, which are typically not in contact with other surfaces or otherwise obstructed during use. Even in a configuration in which two bolsters 42 are placed end-to-end—wherein "end-to-end" means "with the surface of one end 44 placed in interfacial contact with the surface of another end 44"—fluid flow through the respiration window at the end that is not in contact with that of its neighbor is unobstructed. As such, it is clear that bolster structures having different geometries than that of the illustrated embodiment may include a different arrangement of respiration windows and non-respiration regions than as shown and discussed herein.

Moreover, other embodiments may include multiple respiration windows disposed on one or more bolster ends, and/or respiration windows that are not coextensive with the area defining the surface on which the respiration window(s) is/are disposed.

Again, all of such variations are considered to be within the scope of this disclosure.

Also, although not illustrated in the drawings, it will presumably a ways be the case (but not always so) that the mattress overlay 20 will also be provided with one or more respiration windows or like areas or regions in the coating structure thereof that are configured to selectively facilitate fluid flow management, the disposition, arrangement, composition, and/or other characteristics of which may be similar to or vary from those as shown with regard to respiration windows 70.

As explained in greater detail in U.S. patent application Ser. No. 12/960,493, the application process of the coating structure to the overlay—and specifically the curing step following the application of outermost layer—presents a special, exposed surface characteristic manifested is an overall distribution of extremely small, essentially microscopic, suction-cup-like indentations or dimples, which, when it rests upon a conventional hospital bed mattress cover, sticks to that cover, thereby resisting lateral slippage of the overlay relative to the mattress.

It has been found that surfaces provided with the aforementioned dimple distribution also exhibit similar suction-cup adhesion, or stiction, or a stiction grip, when placed in contact with each other. In other words, the stiction-providing surface condition cooperates with other surfaces possessing the same surface condition to prevent lateral relative slippage when engaged therewith.

The illustrated embodiment, accordingly, is provided with one or more outer surfaces adapted to provide the aforementioned interfacial stiction grip, such as a distribution of dimples at certain locations on the overlay and the bolster structure. This surface condition is, for example, shown generally, schematically, and entirely out of scale in FIG. 1, at 72 and 74, corresponding specifically to the outside surfaces of the overlay 20 and bolster structure 40, respectively, that are in contact with each other in the illustrated, deployed arrangement of bolsters 42 engaging the lower surface 22 of the lateral sides 26 of overlay 20. The provision of such a surface condition may be accomplished as noted above, that is, by virtue of the curing step following the application of the outermost layer of the coating structure on either or both the overlay and the bolster structure, or in any suitable manner. Further, the disposition of the dimple distributions may be as desired for example, in the illustrated embodiment, the entirety of the non-respiration region(s) of the coating structure (of both the overlay 20 and the bolster structure 40) is provided with stiction grip capability, which may allow great variation in positional adjustment of the bolster structure relative to the overlay while ensuring that, once deployed in a desired arrangement, the bolster structure will resist migrating from its position during use. Of course, other embodiments may include a combination of gripping surfaces and non-gripping surfaces, for example as a cue to the user that the system is be used in a certain predetermined arrangement (or arrangements) and not in others, and so forth.

Although the present invention has been shown and described with reference to the foregoing operational principles and illustrated examples and embodiments, it will be apparent to those skilled in the art that various changes in form and detail may be made without departing from the spirit and scope of the invention. In one such example, a bolster structure system as described above is configured for use in cooperation with an elongate anti-decubitus ulcer mattress overlay having a different configuration than as cussed herein. The present invention is intended to embrace all such alternatives, modifications and variances that fall within the scope of the appended claims.

The invention claimed is:

1. A mattress overlay system, comprising:

a mattress overlay; and a bolster structure, comprised of one or more moveable bolsters configured to be placed beneath the overlay, wherein the one or more moveable bolsters have an elongated shape with at least one elongated side, wherein the one or more moveable bolsters includes two opposed ends spaced by the at least one elongated side, and wherein the overlay and the bolster structures each further comprise:

a core expanse; and a coating structure bonded to the entirety of the outside of said core expanse, having an outer surface possessing suction-cup-like dimples to provide increased friction against a mattress surface in immediate contact with the outer surface; and at least one respiration-window region being formed on the coating structure to be moisture-pervious and gas-permeable; and at least one non-respiration region being formed on the coating structure to be substantially moisture-impervious and gas-impermeable; and wherein the coating structure provides said moisture-pervious, gas permeable respiration-window regions on at least one end of the one or more moveable bolsters.

2. The mattress overlay system of claim 1, wherein at least one end of the two opposed ends of the one or more moveable bolsters has a first end surface on the at least one end, where the first end surface is separately defined from that of the at least one elongated side.

3. The mattress overlay system of claim 1, wherein the two opposed ends of the one or more moveable bolsters has a first end surface and a second end surface on each of the two opposed ends, where the first end surface and second end surface are separately defined from that of the at least one elongated side.

4. The mattress overlay system of claim 1, wherein the elongated shape of the one or more moveable bolsters has a constant cross-sectional shape along the at least one elongated side, and the two opposed ends of the one or more moveable bolsters create a first end surface and a second end surface on each end that are separately defined from that of the at least one elongated side, and where the first end surface and second end surface each have a shape constant with the constant cross-sectional shape along the at least one elongated side.

5. The mattress overlay system of claim 4, wherein the coating structure provides said moisture-pervious, gas permeable respiration-window regions on the first end surface and the second end surface on the two opposed ends of the one or more moveable bolsters.

6. The mattress overlay system of claim 5, wherein the coating structure provides said at least one non-respiration region that is substantially moisture-impervious and gas-impermeable in the coating structure of the bolster structure being located along the at least one elongated side.

7. The mattress overlay system of claim 4, wherein the constant cross-sectional shape is triangular.

8. The mattress overlay system of claim 4, wherein the coating structure provides at least one of said moisture-pervious, gas permeable respiration-window regions on the at least one elongated side of the one or more moveable bolsters.

9. The mattress overlay system of claim 8, wherein the coating structure provides said at least one non-respiration region that is substantially moisture-impervious and gas-impermeable in the coating structure of the bolster structure being located on the first end and second end surface on the two opposed ends of the one or more moveable bolsters.

10. A mattress overlay system, comprising:

a mattress overlay; and a bolster structure, comprised of one or more moveable bolsters configured to be placed beneath the overlay, the one or more moveable bolsters having an elongated side with an elongated shape, wherein the elongated shape has a constant cross-sectional shape, and two opposed ends spaced by at least one elongated side, wherein the two opposed ends create a first end surface and a second end surface on each end that are separately defined from that of the at least one elongated side and that has a shape constant with the constant cross-sectional shape, and wherein the overlay and the bolster structures each further comprise:

a core expanse; and a coating structure bonded to the entirety of the outside of said core expanse, having an outer surface possessing suction-cup-like dimples to provide increased friction against a surface in immediate contact with the outer surface; and at least one respiration-window region being formed on the coating structure to be moisture-pervious and gas-permeable; and at least one non-respiration region being formed on the coating structure to be substantially moisture-impervious and gas-impermeable; and wherein the coating structure provides said moisture-pervious, gas permeable respiration-window regions on the first end surface of the one or more moveable bolsters.

11. The mattress overlay system of claim 10, wherein the coating structure provides said moisture-pervious, gas permeable respiration-window regions on the second end surface of the one or more moveable bolsters.

12. The mattress overlay system of claim 11, wherein the coating structure provides said at least one non-respiration region that is substantially moisture-impervious and gas-impermeable in the coating structure of the bolster structure being located along the at least one elongated side.

13. The mattress overlay system of claim 10, wherein the coating structure provides at least one of said moisture-pervious, gas permeable respiration-window regions on the at least one elongated side of the one or more moveable bolsters.

14. The mattress overlay system of claim 13, wherein the coating structure provides said at least one non-respiration region that is substantially moisture-impervious and gas-impermeable in the coating structure of the bolster structure being located on the first end surface and the second end surface on the two opposed ends of the one or more moveable bolsters.

15. A mattress overlay system, comprising:

a mattress overlay; and a bolster structure, comprised of one or more moveable bolsters configured to be placed beneath the overlay, the one or more moveable bolsters having three elongated sides with an elongated shape, wherein the elongated shape has a constant cross-sectional shape that is triangular, and two opposed ends spaced by the three elongated sides, wherein the two opposed ends create a first end surface and a second end surface that are separately defined from that of the three elongated sides, where the first end surface and the second end surface have a shape constant with the constant cross-sectional shape, and wherein the overlay and the bolster structures each further comprise:

a core expanse; and a coating structure bonded to the entirety of the outside of said core expanse, having an outer surface possessing suction-cup-like dimples to provide increased friction against a mattress surface in immediate contact with the outer surface; and at least one respiration-window region being formed on the coating structure to be moisture-pervious and gas-permeable; and at least one non-respiration region being formed on the coating structure to be substantially moisture-impervious and gas-impermeable; and wherein the coating structure provides said moisture-pervious, gas permeable respiration-window regions on the first end surface and the second end surface on the two opposed ends of the one or more moveable bolsters, and the coating structure provides said at least one non-respiration region that is substantially moisture-impervious and gas-impermeable in the coating structure of the bolster structure being located along one of the three elongated sides.

16. The mattress overlay system of claim 15, wherein the constant cross-sectional shape that is triangular has a dimensional ratio of 3:4:5.

* * * * *